US006464542B1

(12) United States Patent
Lee

(10) Patent No.: US 6,464,542 B1
(45) Date of Patent: Oct. 15, 2002

(54) CONNECTOR ASSEMBLY HAVING SMALL PROFILE

(75) Inventor: George Lee, Taipei (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/909,730

(22) Filed: Jul. 19, 2001

(51) Int. Cl.[7] ..... H01R 13/04
(52) U.S. Cl. ..... 439/680; 439/679; 439/924.1
(58) Field of Search ..... 439/680, 679, 439/677, 101, 497, 924.1

(56) References Cited

U.S. PATENT DOCUMENTS 5,067,915 A * 11/1991 Kienast ..... 439/679
5,865,651 A * 2/1999 Dague et al. ..... 439/680
5,890,931 A * 4/1999 Ittah et al. ..... 439/679
6,352,449 B1 * 3/2002 Yasuda et al. ..... 439/679

* cited by examiner

*Primary Examiner*—Hien Vu
(74) *Attorney, Agent, or Firm*—Wei Te Chung

(57) ABSTRACT

A power connector assembly (100) includes a plug (1) having a plurality of power pins (12) and signal pins (11) and a socket (2) receiving a plurality of contacts in a plurality of passageways (21, 25) thereof for engaging with corresponding signal pins and power pins. The signal pins of the plug are arranged in a plurality of parallel rows, each signal pin being staggered with other signal pins in a different row. The power pins are arranged at opposite sides of the signal pins and larger than the signal pins.

5 Claims, 7 Drawing Sheets

CONNECTOR ASSEMBLY HAVING SMALL PROFILE

BACKGROUND OF THE INVENTION

1. Field of the Invention

The present invention relates to an electrial connector, and particularly to a power connector assembly for connecting an electrical device to a printed circuit board.

2. Description of Prior Art

Power connector assemblies used in a system are employed not only for interconnecting power circuits and/or data communication cables but also for detecting the system status, e.g. whether the system is using outside power supply, whether the system is under charging or whether the system is using battery pack. A currently used power connector assembly 7 for a notebook, as shown in FIG. 7, has six pins 70 of equal size and aligned in a row, which has a large dimension in a longitudinal direction. Two of the six pins 70 are used as power pins and the others are used as signal pins. However, in recent years, along with an increasing demand for miniaturization in electronic devices, there is also a demand in power connectors for reduced size to minimize occupied space in notebooks and/or on a printed circuit board.

Hence, a power connector assembly with a reduced size is required to overcome the disadvantages of the currently used power connector assembly.

SUMMARY OF THE INVENTION

Accordingly, one object of the present invention is to provide a power connector assembly having an improved pin arrangement thereby economizing the occupied space.

Another object of the present invention is to provide a power connector assembly having an improved pin arrangement thereby reducing the production cost.

In order to achieve the above-mentioned objects, a power connector assembly of the present invention includes a plug having a plug housing receiving a plurality of pins therein including power pins for transmitting power and signal pins for transmitting data, and a socket having a socket housing receiving a plurality of contacts in a plurality of passageways hereof for engaging with corresponding power pins and signal pins of the plug. The signal pins are arranged in a plurality of parallel rows, each signal pin being staggered with other signal pins in a different row. The power pins are arranged at oppositesides of the signal pins and larger than the signal pins. The arrangement of the passageways of the socket are defined corresponding to the pins in the plug. The passageways include outmost passageways and middle passageways. The outmost passageways are designed to receive the power pins and the middle passageways are designed to receive the signal pins. The outmost passageways are larger in dimension than the middle passageways. A printed circuit board defining a plurality of holes therein is provided for engaging with the pins of the plug. The holes are arranged in a plurality of rows and the holes at outmost sides are larger than others for receiving corresponding power pins.

Other objects, advantages and novel features of the invention will become more apparent from the following detailed description when taken in conjunction with the accompanying drawings.

DETAILED DESCRIPTION OF THE INVENTION

Figure 1:
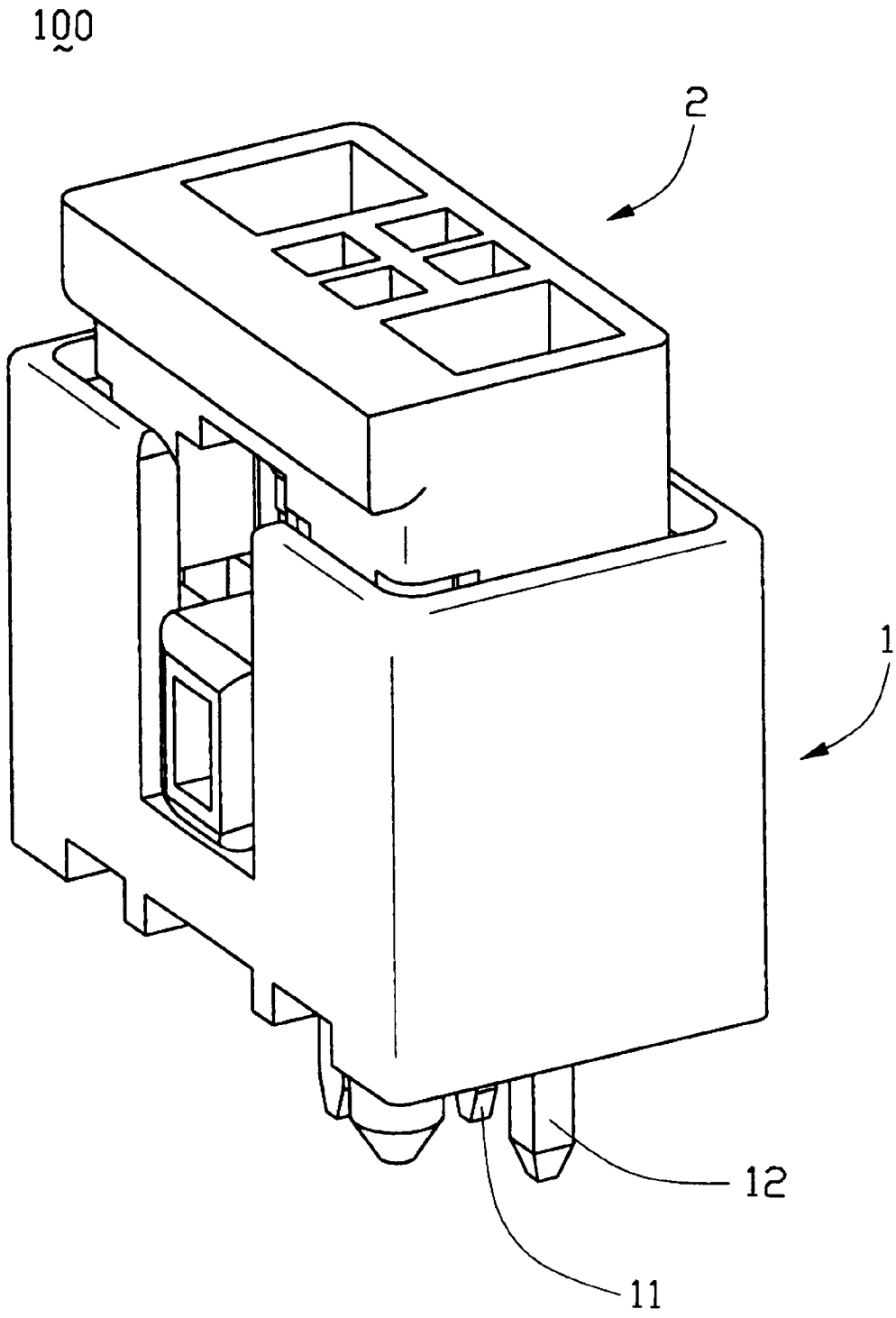
FIG. 1 is a perspective view of a plug-and-socket power connector assembly in accordance with the present invention.

Reference will now be made to the drawing figures to describe the present invention in detail.

Referring to FIG. 1, a power connector assembly 100 in accordance with the present invention comprises a plug 1 having a plurality of pins 11, 12 therein and a socket 2 having a plurality of contacts (not shown) therein. The pins 11, 12 of the plug are adapted to connect to conductive circuits (not shown) on a printed circuit board 3 (FIG. 6) and the contacts of the socket 2 connect to corresponding electrical cable (not shown). The pins 11, 12 and the contacts establish electrical connections between the electrical wires and the printed circuit board 3 when the plug 1 and the socket 2 are coupled together.

Figure 2:
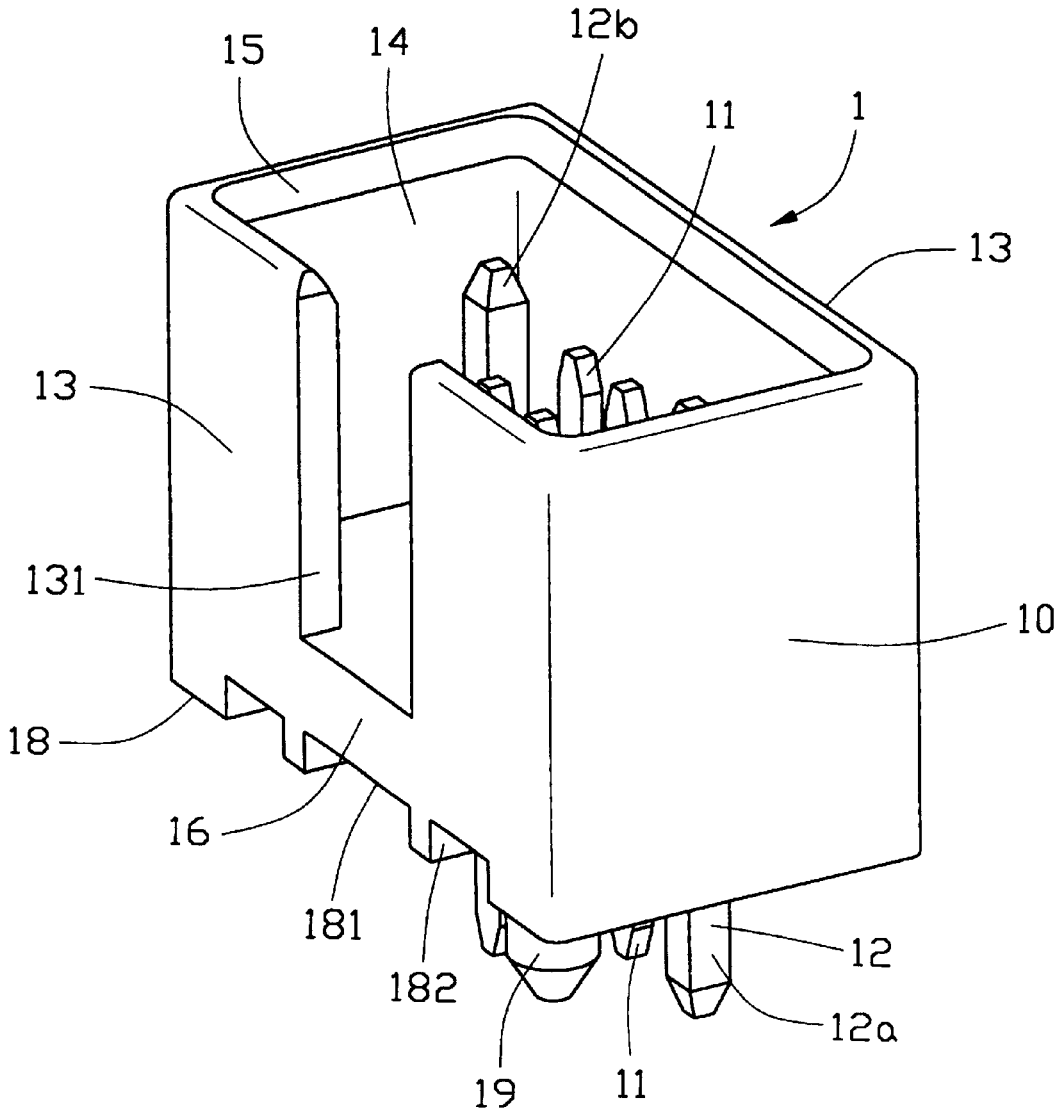
FIG. 2 is a perspective view of a plug of the present invention
Figure 3:
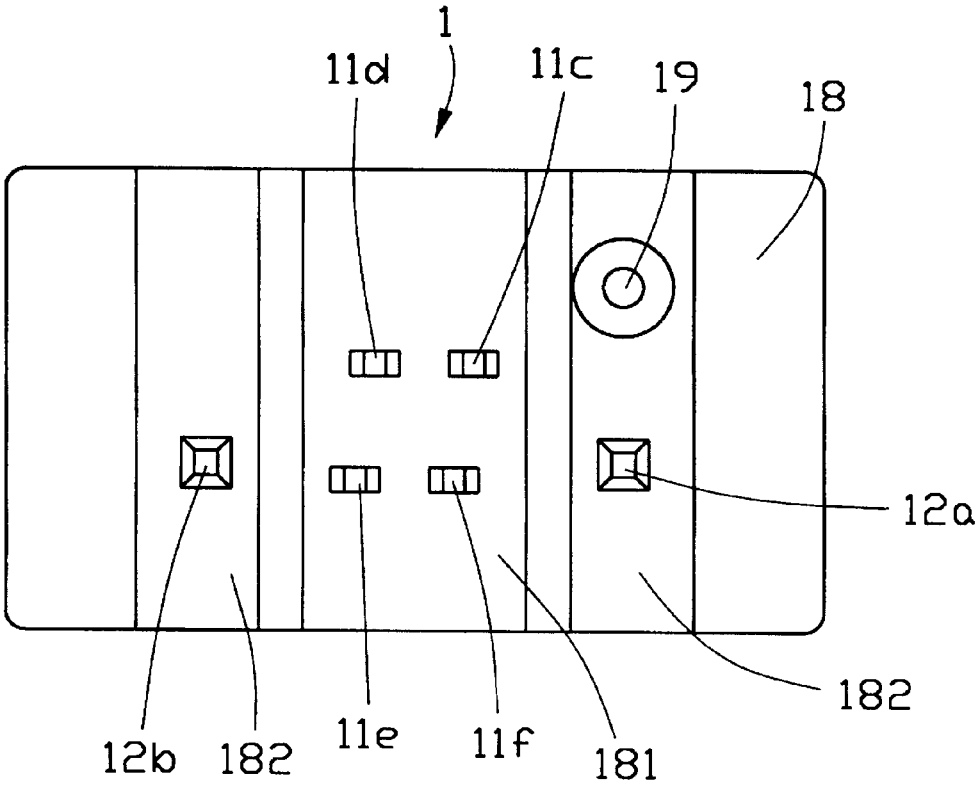
FIG. 3 is a bottom view of the plug shown in FIG. 2.

As shown in FIGS. 2 and 3, the plug 1 of the present invention includes 4 plug housing 10 and a plurality of pins 11, 12 received in the plug housing 10. The plug housing 10 includes four side walls 13 surrounding the plurality of pins 11, 12 and a mating space 14 defined therebetween for receiving the mating socket 2. The plug housing 10 has an entrance 15 on a top thereof for the socket 2 being assembled therethrough into the mating space 14. A notch 131 is defined in one of the side walls 13 and communicates with the mating space 14. One end of the pin 11, 12 is received in the mating space 14, and functions as a contacting portion for engaging with a corresponding contact of the socket 2. The other end of the pin 11, 12 extends through a bottom. wall 16 of the plug housing 10 towards the printed circuit board 3, and fictions as a soldering portion for being soldered to the printed circuit board 3. In the preferred embodiment, the pins 11, 12 of the plug 1 include two power pins 12*a*, 12*b* for power inputoutput power and four signal pins 11*c*, 11*d*, 11*e*, 11*f* for data transmission. The soldering portions of the four signal pins 11*c*, 11*d*, 11*e*, 11*f* are positioned in a middle slot 181 which is defined in a bottom face 18 of the plug housing 10 and are divided into two pairs 11*c*, 11*d* and 11*e*, 11*f*. The signal pins 11 in the same pair are aligned with one another and parallel to the signal pins 11 in the other pair, while each signal pin 11 in the same pair is staggered with other signal pins in different pair. The four signal pins 11*c*, 11*d*, 11*e*, 11*f* are all spaced from each other a predetermined distance. The two power pins 12*a*, 12*b* are located at opposite sides of the four signal pins 11 and the soldering portions thereof are respectively received in two side slots 182 defined in the bottom face 18 of the plug housing 10. The power pins 12 are larger than the signal pins 1 1 as shown in FIG. 3. A post 19 is provided on the bottom face 18 standing near the power pin 12*a* for ensuring a right mating between the pins 11, 12 of the plug 1 and respective holes 30, 31 (FIG. 6) defined in the printed circuit board 3.

Figure 4:
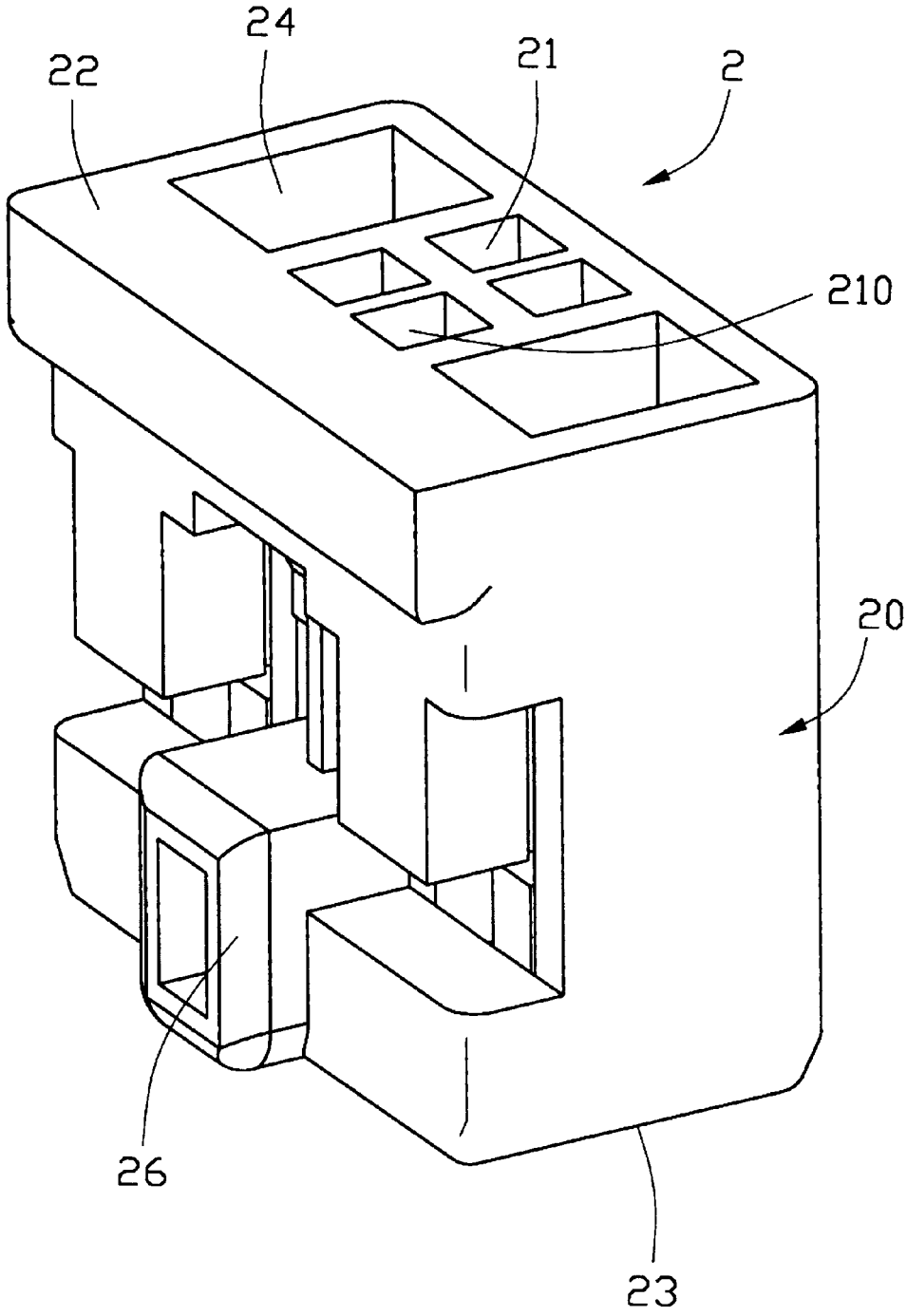
FIG. 4 is a perspective view of a socket of the present invention.
Figure 5:
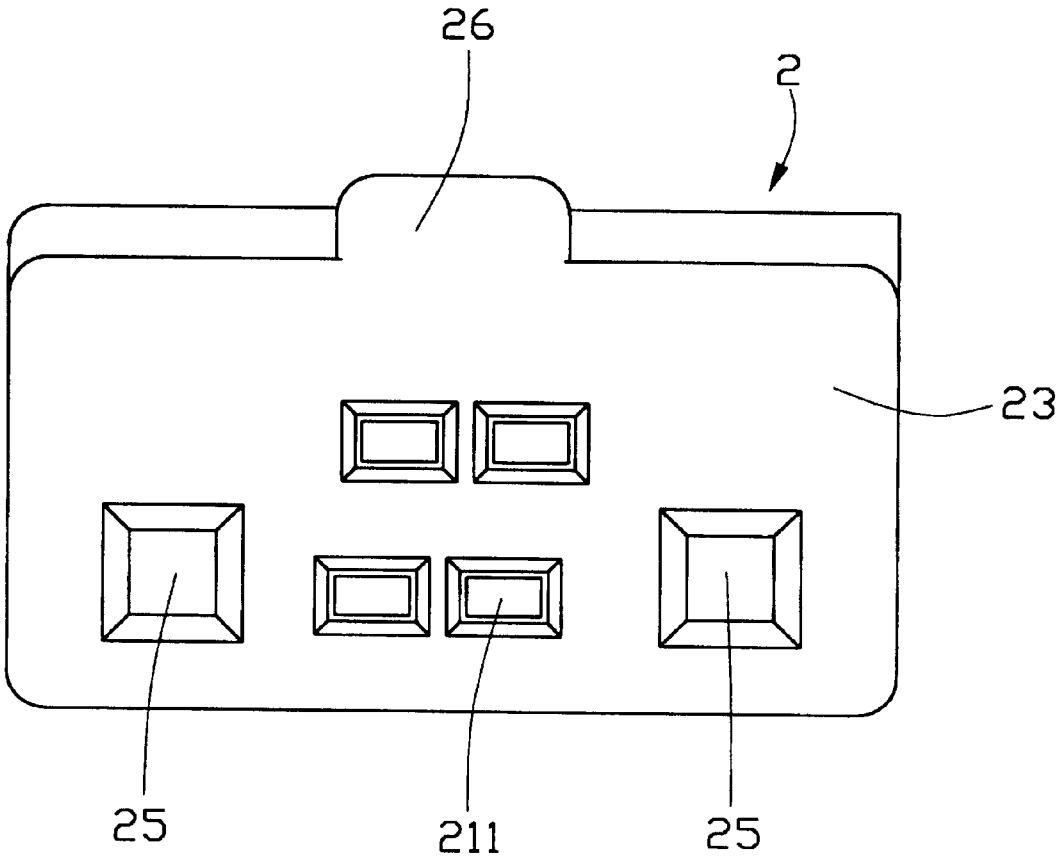
FIG. 5 is a bottom view of the socket shown in FIG. 4.

Referring to FIGS. 4 and 5, the socket 2 of the present invention includes a socket housing 20 and a plurality of contacts received in the socket housing 20. In the preferred embodiment, four passageways 21 are defined in the socket housing 20 extending from a top surface 22 of the socket housing 20 to a bottom surface 23 thereof for receiving corresponding contacts. The four passageways 21 are parallel to each other and include upper passageways 210 defined in the top surface 22 and lower passageways 211 defined in the bottom surface 23. The upper passageways 210 communicate with corresponding lower passageways 211. Two channels 25 are defined in the bottom surface 23 and respectively positioned at both sides of the four lower passageways 211 for correspondingly receiving the power pins 12 of the plug 1. Two openings 24 are defined in the top surface 22 and respectively positioned at both sides of the four upper passageways 210. The two openings 24 communicate with the corresponding channels 25. The socket housing 20 further has a protrusion 26 in the front thereof for correspondingly engaging with the notch 131 of the plug 1 to ensure a right mating between the socket 2 and the plug 1.

Figure 6:
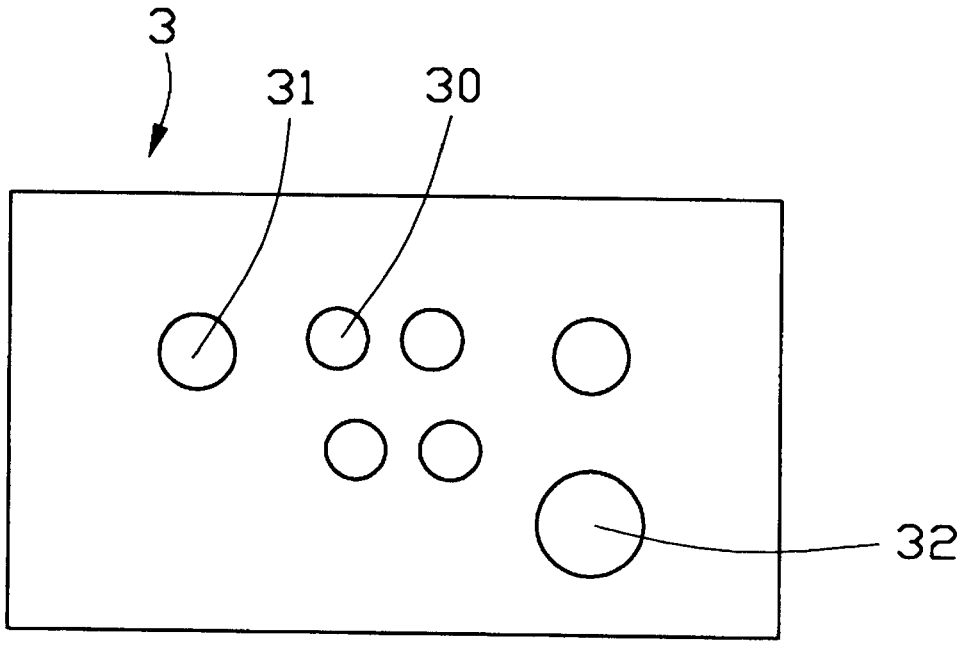
FIG. 6 is a top view of a printed circuit board relating to the present invention.
Figure 7:
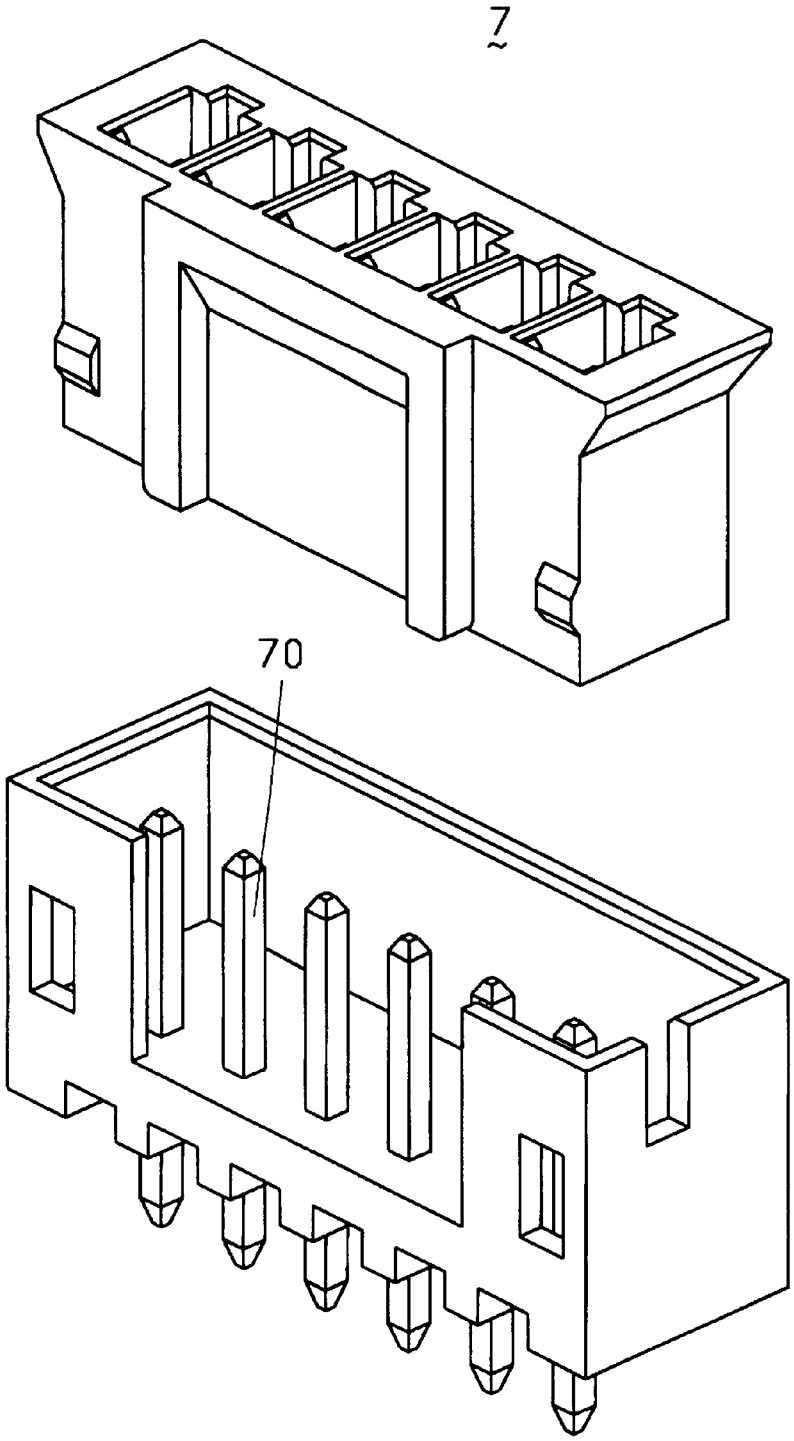
FIG. 7 (PRIOR ART)
FIG. 7 is a perspective, exploded view of a conventional power connector assembly.

As shown in FIG. 6, the holes 30 defined in the printed circuit board 3 are arranged in two rows and staggered with each other for engaging with the corresponding signal pins 11 of the plug 1. Two holes 31, diameter of which is larger than that of the holes 30, are positioned at two opposite sides of the holes 30 for engaging with the corresponding power pins 12 of the plug 1. The aperture 32 is aligned with one of the holes 31 for retaining the post 19 of the plug 1.

In assembly, firstly, the plug 1 is assembled to the printed circuit board 3 with the post 19 thereof being inserted into the aperture 32 of the printed circuit board 3, and the pins 11, 12 of the plug 1 are received in the corresponding holes 30, 31 in the printed circuit board 3 and then soldered thereto. Then, the socket 2 is inserted into the mating space 14 of the plug 1 from the entrance 15 of the plug housing 10, whereby the power and signal pins 11, 12 of the plug 1 are received in the corresponding channels 25 and passageways 21, and the protrusion 26 of the socket 2 is engaged with the notch 131 of the plug 1 to ensure a right engagement.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A power electrical connector assembly comprising:

a plug having a plug housing receiving a plurality of pins therein, the plurality of pins including power pins for transmitting power and signal pins for transmitting data, the signal pins being arranged in a plurality of rows, each row being parallel to others arid each signal pin being staggered with other signal pins in a different row, the power pins being arranged at opposite sides of the signal pins and each having a size larger than the signal pin; and a socket having a socket hoising and a plurality of passageways receiving a plurality of contacts therein for engaging with corresponding power pins and signal pins of the plug, the arrangement of the passageways corresponding to that of the pins in the plug, the passageways including outmost passageways and middle passageways, the outmost passageways being designed to receive the power pins of the plug and the middle passageways being designed to receive the signal pins of the plug, each outmost passageway having a dimension larger than the middle passageway; wherein the plug housing has a bottom face defining a plurality of slots therein, the plurality of slots including a middle slot and two side slots; wherein the plug housing has side walls, the side walls defining a mating space therebetween for receiving the socket; wherein one of the side walls of the plug housing defines a notch therein communicating with the mating space, and wherein the socket housing has a protrusion for being correspondingly received in the notch to ensure a right engagement between the plug and the socket.

2. The power connector assembly as described in claim 1, wherein one end of the pin extending into the plug housing is a contacting portion and the other end of the pin extending outside the plug housing is a soldering portion, the soldering portions of the signal pins being positioned in the middle slot and the soldering portions of the flower pins being positioned in the side slots.

3. The power connector assembly as described in claim 1, wherein a post is formed on the bottom face of the plug housing and aligns with one of the power pins.

4. A power electrical connector assembly comprising:

a plug having a plug housing and a plurality of power pins and signal pins received in the plug housing, the signal pins being arranged in a plurality of rows parallel to each others each signal pin being staggered with other signal pins in a different row, the power pins being larger than the signal pins and positioned at outmost sides of the signal pins;

a socket having a socket housing defining a plurality of passageways therein and a plurality of contacts received in the passageways for engaging with one end of corresponding power pins and signal pins of the plug, the arrangement of the passageways corresponding to that of the pins in the plug, the passageways including outmost passageways and middle passageways, the outmost passageways being designed to receive the power pins and the middle passageways being designed to receive the signal pins, each outmost passageway having a dimension larger than the middle passageway; and a printed circuit board defining a plurality of holes therein for engaging with the power pins and signal pins of the plug at the other end thereof opposite to the end contacting the contacts of the socket, the holes being arranged in a plurality of rows, the holes at outmost sides being larger than the others for receiving corresponding power pins; wherein the plug housing has a bottom race defining a plurality of slots therein, the plurality of slots including a middle slot and side slots, the power pins being positioned in the side slots and the signal pins being positioned in the side slots;

wherein the plug has side walls defining a mating space therebetween for receiving the socket, one of the side walls defining a notch communicating with the mating space, and wherein the socket provides a protrusion thereon for engaging with the notch.

5. The power connector assembly as described in claim 4, wherein the plug housing has a post formed on the bottom face thereof, and wherein the printed circuit board defmes an aperture for receiving the post, the post being aligned with one of the power pins.

* * * * *